US006991505B1

(12) United States Patent
Wells

(10) Patent No.: US 6,991,505 B1
(45) Date of Patent: Jan. 31, 2006

(54) BUOYANT APPARATUS FOR ATTACHMENT TO BEVERAGE INSULATORS HOLDING BEVERAGE CONTAINERS

(75) Inventor: Robert Ray Wells, Charlotte, NC (US)

(73) Assignee: USAdvantage, Inc., Charlotte, NC (US)

( * ) Notice: Subject to any disclaimer, the term of this patent is extended or adjusted under 35 U.S.C. 154(b) by 71 days.

(21) Appl. No.: 10/834,948

(22) Filed: Apr. 29, 2004

(51) Int. Cl.
*B63C 35/85* (2006.01)

(52) U.S. Cl. ..... 441/136; 220/560

(58) Field of Classification Search ..... 441/136; 220/560

See application file for complete search history.

(56) References Cited

U.S. PATENT DOCUMENTS 4,571,194 A * 2/1986 Kiss et al. ..... 441/1
5,088,948 A 2/1992 Scheurer
5,727,709 A 3/1998 Nobile
6,607,090 B1 8/2003 Doerr
6,616,493 B2 9/2003 Powell et al.

* cited by examiner

*Primary Examiner*—Jesus D. Sotelo
(74) *Attorney, Agent, or Firm*—Jason S. Miller

(57) ABSTRACT

A buoyant apparatus for connection to a beverage insulator, comprising an elongate arm having a rod like configuration and including an upper portion and a lower portion, said upper and lower portions being joined at a predetermined angle; a top plate connected to the upper portion of the elongate arm member having a slot and/or air vent located therein; and a stabilizer weight connected to the lower portion of the arm operable for stabilizing the buoyant apparatus in moderately rough aquatic action, wherein the buoyant apparatus is inserted into the beverage insulator by passing the elongate arm through a flexible air vent located in a bottom wall of the beverage insulator.

20 Claims, 2 Drawing Sheets

BUOYANT APPARATUS FOR ATTACHMENT TO BEVERAGE INSULATORS HOLDING BEVERAGE CONTAINERS

BACKGROUND OF THE INVENTION

1. Field of the Invention

The present invention relates generally to buoyant devices for supporting otherwise unstable objects, and more specifically, to a buoyant apparatus for attachment to beverage insulators operable for holding beverage containers wherein the center of gravity of the combined assembly and beverage container inhibits tipping and/or spilling of the contents of the beverage container in moderately rough aquatic action.

2. Description of the Related Art

Persons who enjoy recreational water activities, such as swimming, floating and fishing, frequently desire access to beverages while in the water. However, during such recreational activities, it is typically undesirable to continuously hold a beverage container because the use of both hands may be necessary to fully enjoy the recreational activity.

To address this problem, a variety of conventional floating beverage holders have been developed which can support one or more beverage containers on the surface of the water. Existing floating beverage holders, however, present a number of drawbacks. For example, most conventional floating beverage holders will not accommodate beverage containers of various sizes (i.e., having varying outside diameters). This is particularly disadvantageous when a person desires to use a beverage insulator to keep their beverage hot or cold. Because the thickness of conventional beverage insulators can vary greatly depending on their specific material of construction, insulated beverage containers will frequently not be suitable for use with conventional floating beverage holders.

A further disadvantage of existing floating beverage holders is their size. The bulkiness of these conventional devices makes it undesirable and/or impractical to pack, transport, and store these devices. Indeed, many of these devices maintain their buoyant properties via a donut shape or a flat displacement across the surface of water. This disadvantage is especially pronounced when persons enjoy recreational water activities at locations requiring substantial travel. When packing a limited amount of supplies to travel to a remote recreation location, including a bulky conventional floating beverage holder may simply be impractical.

A still further disadvantage of conventional floating beverage holders is the fact that the beverage container must be removed and reinserted into the holder every time the user takes a drink. This removal/reinsertion action can be difficult in the water, and often requires the use of two hands to grasp both the holder and the beverage container. The use of two hands to remove and reinsert the beverage into the holder can make the use of conventional floating beverage holders impractical, especially when enjoying recreational activities requiring the use of two hands.

By way of example, U.S. Pat. No. 6,616,493 entitled Floatable Beverage Holder to Powell et al. teaches of a buoy which is suitable for supporting various sizes of beverage containers and allows the center of gravity of the combined buoy and container to be readily adjusted in order to restrain tipping. Powell et al fails to teach of a device that can comfortably be used while drinking from the beverage container. Indeed, a user must remove the beverage container prior to drinking.

An additional disadvantage of conventional floating beverage holders is that they tend to float away from the individual, thus making it necessary for the individual to relocate towards the beverage holder in order to take a drink of the beverage.

A still further disadvantage of conventional floating beverage holders is the fact that the beverage container must be removed for the holder to sit safely on an edge of a pool, boat railing, or table edge when the user so desires. For example, the user would like to change an empty beverage container for a full beverage container.

Thus, it is apparent that there is, therefore, a need in the art for a buoyant apparatus for attachment to and/or removal from a beverage insulator operable for receiving beverage containers which possesses sufficiently buoyant characteristics such that it will float while supporting a full beverage container with sufficient stability such that the container will not tip or spill its contents against moderately rough waves. There is a further need in the art for a a buoyant apparatus for attachment to and/or removal from a beverage insulator operable for receiving beverage containers, said apparatus having an offset characteristic with a center of gravity such that the buoyant apparatus and a full beverage container can safely sit on the edge of any rigid object if the user so desires.

OBJECTS OF THE INVENTION

Having briefly described the general nature of the present invention, it is a principal object thereof to provide a buoyant apparatus operable for connection to and removal from a beverage insulator, such as a Koozie™, which is designed and constructed to have sufficient stability in moderately rough wave action.

It is another object of the present invention to provide a buoyant apparatus operable for connection to and removal from a beverage insulator which has features of design and construction that render it easy to grasp and hold, is inexpensive to manufacture, and requires virtually no maintenance and is easily transportable.

It is still a further object of the present invention to provide a buoyant apparatus operable for connection to and removal from a beverage insulator that has a unitary design and construction.

It is still a further object of the present invention to provide a buoyant apparatus operable for connection to and removal from a beverage insulator that is capable of being secured in a predetermined location or affixed to the user via a tether.

It is still a further object of the present invention to provide a buoyant apparatus operable for connection to and removal from a beverage insulator with or without the beverage container that is capable of safely sitting on the edge of any rigid object if the user so desires.

These and other objects and advantages of the present invention will become more apparent from an understanding of the following summary and detailed description of the presently preferred embodiments of the present invention considered in conjunction with the accompanying drawings.

BRIEF SUMMARY OF THE INVENTION

To achieve the foregoing and other objects, and in accordance with the purpose of the present invention as embodied and broadly described herein, the present invention generally provides various embodiments of a buoyant apparatus or bobber operable for connection to and removal from a beverage insulator, such as a Koozy, sufficient for holding a beverage container. The present invention has the advantages of being easily and readily affixed and removed to the beverage insulator and of being sufficiently buoyant to maintain a full beverage container that is inserted into the beverage insulator above the surface of water. The buoyant apparatus of the present invention is also operable for permitting a user to store and hold a beverage container such that the beverage container is maintained in its upright position and such that the contents therein will not be spilled or contaminated by water from moderately rough aquatic action.

In an exemplary embodiment, the present invention provides a buoyant apparatus for attachment to a beverage insulator which is operable for supporting a beverage container in an aquatic environment, such as a pool or lake. The buoyant apparatus is generally unitary in construction and comprises an elongate arm member having a generally rod like configuration, said elongate arm member consisting of an upper portion and a lower portion. The upper and lower portions of the elongate arm member are connected at a predetermined location and formed such that an angle coincident with the center of gravity of an average full beverage container exists. The design and configuration of the elongate arm member maximizes the stability of the present invention when used in an aquatic environment.

An aperture is optionally provided through the upper portion of the elongate arm member such that a tether device can readily and easily be attached and removed. The tether device is operable for allowing a user to secure the combined assembly of the buoyant apparatus and the beverage insulator at a predetermined location or to the user, thereby preventing the combined assembly from floating away to an undesirable distance.

Joined at the distal end of the upper portion of the elongate arm member is a generally disc shaped top plate having a flat upper side, an underside and a beveled edge extending around the perimeter of the underside. The top plate is perpendicularly affixed to the upper portion of the elongate arm member such that top plate's centerline and the elongate arm are offset, thereby allowing a flat base above and below the top plate. Further, the top plate includes a hole in the center or a slot extending from the periphery to the center through which air can pass.

A stabilization weight is mounted to the distal end of the lower portion of the elongate arm member for assisting in maintaining the combined assembly in a upright position when the assembly is immersed in water, thereby preventing the beverage container from spilling its contents or likewise having the beverage container contaminated with the water in which it is immersed.

In operation, the buoyant apparatus is inserted into the beverage insulator such that the stabilization weight and the elongate arm member pass through a flexible air hole and/or cut of the bottom wall of the beverage insulator. The buoyant apparatus is inserted into the beverage insulator until the underside of the top plate contacts the bottom wall of the beverage insulator. The hole or slot of the top plate permits air to escape from the space located between the top plate the beverage insulator as the buoyant apparatus is inserted therein. Once the buoyant apparatus is completely inserted into the beverage insulator, a beverage container, such as aluminum can, can be inserted therein, preferably until it contacts the upper side of the top plate and rests on thereon.

Thereafter, the combined assembly is placed into water, a pool, or the like. Upon placement into the water, the combined assembly partially sinks into the water with the buoyancy of the assembly supporting and maintaining and beverage container in an upright position on the surface of the water. The angled connection of the upper and lower portions of the elongate arm member and the stabilization weight ensure that spillage and contamination of the contents of the beverage container is prevented. Additionally, after insertion of the buoyant apparatus into the beverage insulator, the combination thereof may be optionally tethered to a predetermined location or the user by passing a tether through the aperture of the upper portion of the elongate arm member and securing it in place.

BRIEF DESCRIPTION OF THE DRAWINGS

These and other features, aspects and advantages of the present invention are better understood when the following detailed description of the invention is read with reference to the accompanying drawings, wherein.

Figure 1:
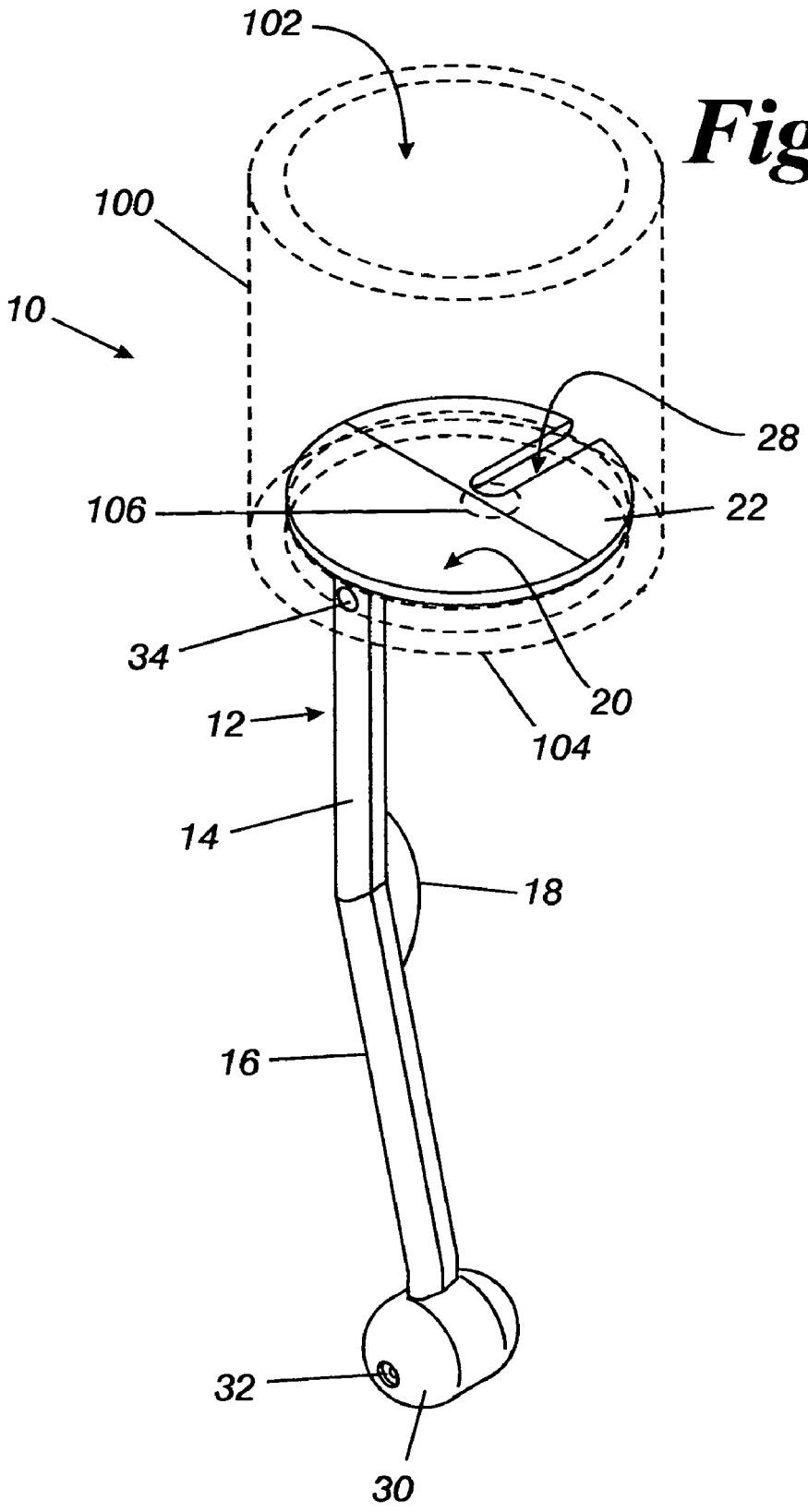
FIG. 1 is a perspective view of the buoyant apparatus/bobber including a beverage insulator, or Koozy, in accordance with an exemplary embodiment of the present invention.

It is to be understood that the drawings are merely illustrative of the invention and are not meant to limit the claims. Various modifications and additions may be made to the apparatus by those skilled in the art, without departing from the spirit and scope of this invention, which is therefore understood to be limited only by the scope of the appended claims. Further, the same reference numerals refer to the same parts throughout the various Figures.

DETAILED DESCRIPTION OF THE INVENTION

As required, detailed embodiments of the present invention are disclosed herein. However, it is to be understood by one of ordinary skill in the art that the present discussion is a description of exemplary embodiments only and is not intended as limiting the broader aspects of the present invention, which broader aspects are embodied in the exemplary construction. The present invention as described more fully hereinafter with reference to the accompanying drawings in which exemplary embodiments of the invention are shown. This invention may, however, be embodied in many different forms and should not be construed as limited to the embodiments set forth herein. These exemplary embodiments are shown and described so that this disclosure will be both thorough and complete, and will fully convey the scope of the invention to those skilled in the art. Like reference numbers refer to like elements throughout the various drawings.

The present invention provides various embodiments of a buoyant apparatus/bobber operable for connection to and removal from a beverage insulator sufficient for holding beverage containers. The combined assembly of the buoyant apparatus and the beverage insulator is operable for maintaining beverage containers in an upright position while supporting the same in water. The buoyant apparatus may generally include an elongate arm member including a tether hole, a stabilization weight, and a top plate for supporting a beverage container. In all embodiments envisioned herein, the buoyant apparatus is connected to a beverage insulator such that the top plate of the buoyant apparatus is inside the beverage insulator while the elongate arm member is external.

The present invention is preferably of a unitary construction and is useful with any neutrally buoyant plastic polymeric, or elastomeric material or any combination thereof that is UV resistant. By unitary, it is meant that the present invention is formed as one continuous apparatus as opposed to separate parts which are joined together to form one apparatus. Suitable plastics are recycled plastics, injection molded plastics, reinforced plastics or the like generally comprised of polypropylene, polyethylene, and polyvinylchloride. Suitable methods of manufacture of the buoyant apparatus are injection molding and casting.

Figure 2:
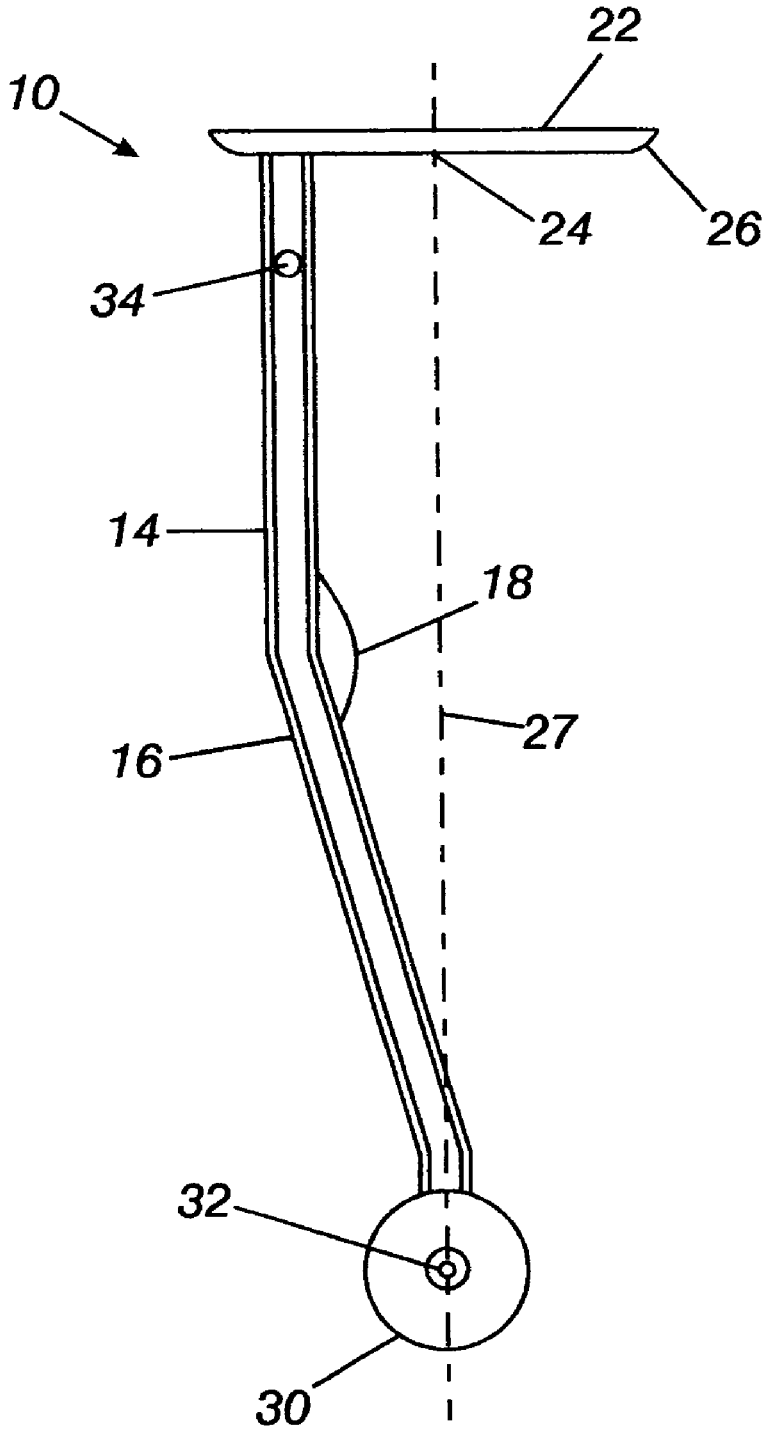
FIG. 2 is a side view of a buoyant apparatus/bobber without the beverage insulator in accordance with an exemplary embodiment of the present invention.

Referring now to FIGS. 1 and 2, a buoyant apparatus 10 for connection to and removal from a beverage insulator 100 constructed in accordance with an exemplary embodiment of the present invention is shown. The buoyant apparatus 10 permits a beverage container (not shown) to be readily and easily disposed in the combined assembly of the buoyant apparatus 10 and the beverage insulator 100, and supported in a liquid such as water. As is well known and understood in the art, the beverage container may be any conventional beverage container, such as for example, but without limitation, a can or bottle of soda or other drink. The buoyant apparatus 10 provides a convenient manner for a user (not shown) to maintain a beverage container in water without spilling the contents thereof and without the burden and necessity of holding the beverage container directly.

As is also well known and understood in the art, a beverage insulator 100, also known as a "Koozie," is a cylindrical device comprised of a cylindrical structure with an open end 102 and a closed end or bottom wall 104. The bottom wall 104 of the Koozie preferably has a flexible air hole 106 located therethrough for permitting a beverage container to easily and readily be inserted and removed. The open end 102 of the beverage insulator 100 can be flared to have a greater inside and outside diameter than closed end 104. The beverage insulator 100 is dimensioned to snugly fit around a standard aluminum beverage container, can, or the like. Therefore, the inner diameter is preferably 2½ inches or less while the height is 4⅛ inches or less. The beverage insulator 100 is typically made of a flexible insulating material which allows for placement of slightly larger diameter cans or bottles therein. The insulating material is preferably a closed cell foam with small air pockets therein. This insulating material retains its positive buoyancy when wet. Conventional insulating receptacles and devices inhibit heat transfer by preventing convective heat transfer from a large percentage of the can's surface area. The beverage insulator 100 also inhibits conductive heat transfer by presenting a material with a low heat transfer coefficient adjacent to the highly conductive aluminum can.

Referring back to the FIGS. 1 and 2, in an exemplary embodiment, the present invention provides the buoyant apparatus 10 for supporting a beverage container for use in an aquatic environment, such as a pool or lake. The buoyant apparatus 10 generally comprises an elongate arm member 12 having a generally rod like configuration, said elongate arm consisting of an upper portion 14 and a lower portion 16. The upper and lower portions, 14 and 16 respectively, of the arm member 12 are connected at a predetermined location and formed such that an angle $\alpha$ 18 coincident with the vertical centerline that passes through the center of gravity of an average full beverage container exists.

Joined at the distal end of the upper portion 14 of the elongate arm member 12 is a generally disc shaped top plate 20 having a flat upper side 22, an underside 24 and a beveled edge 26 extending around the perimeter of the underside 24. The top plate 20 is perpendicularly affixed to the upper portion 14 of the arm member 12 such that the top plate's vertical centerline 27 and the arm member 12 are offset, thereby allowing the underside 24 of top plate 20 to remain flat at an area around the top plate's vertical centerline 27. Further, the top plate 20 includes a slot 28 extending from the periphery to the center.

A stabilization weight 30 is mounted to the distal end of the lower portion 16 of the elongate arm member 12 for assisting in maintaining the buoyant apparatus 10 in a upright position when the buoyant apparatus 10 is immersed in water, thereby preventing the beverage container from spilling its contents or likewise having the beverage container contaminated with the water in which it is immersed. The stabilization weight 30 preferably includes a metal weight 32 encased in the neutrally buoyant plastic polymeric or elastomeric material that comprises the present invention. Further, the stabilization weight preferably weighs 3 oz., however, it will be understood by those skilled in the art that various weights may be employed depending on the intended size of the beverage container.

As shown in FIG. 1, the buoyant apparatus 10 can optionally include an aperture 34 through the upper portion 14 of the elongate arm member 12 operable for receiving a tether device (not shown) for securing the combined assembly of the buoyant apparatus 10 and the beverage insulator 100 in place. A clip or other conventional fastening means (not shown) can be coupled to the opposite end of the tether coupled to the combined assembly. The fastening means can be manually operable such that it can readily and easily be fastened to an anchoring device such as for example, an article of clothing worn by the user of the combined assembly. Thus, the tether can prevent the combined assembly from floating out of reach of the user. Further, tether can be used to retrieve the combined assembly by simply pulling the tether towards the user.

In operation, the buoyant apparatus 10 is inserted into the beverage insulator 100 by slidably manipulating the stabilization weight 30 and the elongate arm member 12 through the flexible air hole and/or cut 106 of the bottom wall 104 of the beverage insulator 100. The buoyant apparatus 10 is inserted into the beverage insulator 100 until the underside 24 of the top plate 20 contacts the top of the bottom wall 104 of the beverage insulator 100. As the buoyant apparatus 10 is being inserted, air contained within the interior of the beverage insulator 100 is released through the air hole and/or cut 106. The beveled edge 26 of the underside 24 of the top plate 20 allow for easy insertion of the buoyant apparatus 10 into the beverage insulator 100. Further, the top plate 20 is configured such that its diameter is slightly larger than the interior diameter of the beverage insulator 100 such that the top plate 20 fits snugly when inserted in place on the top of the bottom wall 104. Once the buoyant apparatus 10 is completely inserted into the beverage insulator 100, a beverage container, such as aluminum can, can be inserted therein, preferably until it contacts the upper side 22 of the top plate 20 and rests on the upper side 22. The air hole and/or cut 106 of the beverage insulator 100 and the slot and/or air vent 28 in the top plate 20 allow for the beverage container to easily be inserted and removed by allowing air to pass therethrough.

Thereafter, the combined assembly of the beverage insulator 100 and the buoyant apparatus 10 holding the beverage container is placed into water, a pool, a lake or the like. Upon placement into the water, the combined assembly partially sinks into the water with the buoyancy of the combined assembly supporting and maintaining and beverage container in an upright position on the surface of the water. The angled elongate arm member 12 and the stabilization weight 30 ensure that spillage and contamination of the contents of the beverage container is prevented. Additionally, after insertion of the buoyant apparatus 10 into the beverage insulator 100, the combination thereof may be optionally tethered to a predetermined location or the user by passing a tether through the aperture 34 of the upper portion 14 of the elongate arm member 12 and securing it in place.

Subsequent to the use of the combined assembly, the beverage container can easily be removed therefrom. Further, the buoyant apparatus 10 can easily and readily be removed from the beverage insulator 100 by slidably manipulating the elongate arm member 12 and stabilization weight 30 through the flexible air hole and/or cut 106 of the bottom wall 104 and out of the interior cavity.

SUMMARY OF THE ACHIEVEMENT OF THE OBJECTS OF THE INVENTION

From the foregoing, it is readily apparent that I have invented a buoyant apparatus/bobber operable for connection to and removal from a beverage insulator, such as a Koozie, which is designed and constructed to have sufficient stability in moderately rough wave action.

Still further, it is apparent that I have invented a buoyant apparatus operable for connection to and removal from a beverage insulator which has features of design and construction that render it easy to grasp and hold, is inexpensive to manufacture, and requires virtually no maintenance and is easily transportable.

Still further, it is apparent that I have invented a buoyant apparatus operable for connection to and removal from a beverage insulator that has a unitary design and construction.

Still further, it is apparent that I have invented a buoyant apparatus operable for connection to and removal from a beverage insulator that is capable of being secured in a predetermined location or affixed to the user via a tether.

Still further, it is apparent that I have invented a buoyant apparatus operable for connection to and removal from a beverage insulator with or without the beverage container that is capable of safely sitting on the edge of any rigid object.

The foregoing is a description of various embodiments of the invention that are given here by way of example only. Although a buoyant apparatus for connection to and removal from a beverage insulator operable for receiving a beverage container has been described with reference to preferred embodiments and examples thereof, other embodiments and examples may perform similar functions and/or achieve similar results. All such equivalent embodiments and examples are within the spirit and scope of the present invention and are intended to be covered by the appended claims.

That which is claimed is:

1. A buoyant apparatus for connection to a beverage insulator operable for receiving and maintaining a beverage container, comprising:

an elongate arm member having an upper portion and a lower portion, said upper and lower portions being joined at a predetermined angle that is coincident with a vertical centerline that passes through the center of gravity of the beverage container and the beverage insulator;

a generally disc shaped top plate connected to the upper portion of the elongate arm member having an air slot located therein; and a stabilizer weight connected to the lower portion of the arm that is coincident with the vertical centerline that passes through the center of gravity of the beverage container and the beverage insulator operable for stabilizing the buoyant apparatus in moderately rough aquatic action.

2. The buoyant apparatus of claim 1, wherein said generally disc shaped top plate is connected offset to the upper portion of the elongate arm member such that the bottom of the top plate is flat and can sit safely on a rigid edge.

3. The buoyant apparatus of claim 1, wherein a tether hole is provided in the upper portion of the elongate arm member such that a tether device may be secured at one end of the elongate arm member and secured to a desired location at the other end.

4. The buoyant apparatus of claim 1, wherein the buoyant apparatus is inserted into the beverage insulator by passing the elongate arm member through a flexible air hole located in a bottom wall of the beverage insulator.

5. The buoyant apparatus of claim 1, wherein the top plate includes an upper side and a lower side, the lower side having a beveled edge operable for permitting easier insertion of the buoyant apparatus into the beverage insulator.

6. The buoyant apparatus of claim 1, wherein the stabilizer weight weighs 3 oz.

7. The buoyant apparatus of claim 1, wherein the apparatus is unitary in construction and is manufactured by injection molding a neutrally buoyant polymeric or elastomeric material around a stabilizer weight.

8. A buoyant apparatus for connection to a beverage insulator, comprising:

an elongate arm having a rod like configuration and including an upper portion and a lower portion, said upper and lower portions being joined at a predetermined angle;

a top plate connected to the upper portion of the elongate arm having an air vent located therein; and a stabilizer weight connected to the lower portion of the arm operable for stabilizing the buoyant apparatus in moderately rough aquatic action.

9. The buoyant apparatus of claim 8, wherein said top plate is connected offset to the upper portion of the elongate arm member so that the bottom of the top plate is flat and can sit safely on any rigid edge.

10. The buoyant apparatus of claim 8, wherein an aperture is provided in the upper portion of the elongate arm such that a tether device may be secured at one end of the elongate arm and secured to a desired location at the other end.

11. The buoyant apparatus of claim 8, wherein the buoyant apparatus is inserted into the beverage insulator by passing the elongate arm through a flexible air hole located in a bottom wall of the beverage insulator.

12. The buoyant apparatus of claim 8, wherein the top plate has a disc shape and includes an upper side and a lower side, the lower side having a beveled edge operable for permitting easier insertion of the buoyant apparatus into the beverage insulator.

13. The buoyant apparatus of claim 8, wherein the stabilizer weight weighs 3 oz.

14. The buoyant apparatus of claim 8, wherein the apparatus is unitary in construction and is manufactured by injection molding a neutrally buoyant polymeric or elastomeric material around a stabilizer weight.

15. A buoyant apparatus for connection to a beverage insulator, comprising:

an elongate arm having a rod like configuration and including an upper portion and a lower portion, said upper and lower portions being joined at a predetermined angle;

a top plate connected to the upper portion of the elongate arm having an air vent located therein; and a stabilizer weight connected to the lower portion of the arm operable for stabilizing the buoyant apparatus in moderately rough aquatic action, wherein the buoyant apparatus is inserted into the beverage insulator by passing the elongate arm through a flexible air hole located in a bottom wall of the beverage insulator.

16. The buoyant apparatus of claim 15, wherein said top plate is connected offset to the upper portion of the elongate arm such that the bottom of the top plate is flat and can sit safely on any rigid edge.

17. The buoyant apparatus of claim 15, wherein an aperture is provided in the upper portion of the elongate arm such that a tether device may be secured at one end of the elongate arm and secured to a desired location at the other end.

18. The buoyant apparatus of claim 15, wherein the top plate has a disc shape and includes an upper side and a lower side, the lower side having a beveled edge operable for permitting easier insertion of the buoyant apparatus into the beverage insulator.

19. The buoyant apparatus of claim 15, wherein the stabilizer weight weighs 3 oz.

20. The buoyant apparatus of claim 15, wherein the apparatus is unitary in construction and is manufactured by injection molding a neutrally buoyant polymeric or elastomeric material around a stabilizer weight.

* * * * *